US010434393B2

(12) United States Patent
Young

(10) Patent No.: US 10,434,393 B2
(45) **Date of Patent: *Oct. 8, 2019**

(54) BASKETBALL SHOT TRAINING DEVICE TO IMPROVE JUMP SHOTS

(71) Applicant: Natalie Nicole Young, Richmond Hill, NY (US)

(72) Inventor: Natalie Nicole Young, Richmond Hill, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/727,518

(22) Filed: Oct. 6, 2017

(65) Prior Publication Data

US 2018/0099200 A1 Apr. 12, 2018

Related U.S. Application Data

(60) Provisional application No. 62/405,821, filed on Oct. 7, 2016.

(51) Int. Cl.

| | |
|---|---|
| ***A63B 69/00*** | (2006.01) |
| *A63B 21/00* | (2006.01) |
| *A63B 71/06* | (2006.01) |

(52) U.S. Cl.

CPC ..... *A63B 69/0071* (2013.01); *A63B 69/0059* (2013.01); *A63B 21/00189* (2013.01); *A63B 21/4019* (2015.10); *A63B 21/4021* (2015.10); *A63B 21/4025* (2015.10); *A63B 2071/0625* (2013.01); *A63B 2071/0633* (2013.01); *A63B 2209/10* (2013.01); *A63B 2209/14* (2013.01); *A63B 2225/09* (2013.01)

(58) Field of Classification Search

CPC ..... A63B 69/0071; A63B 69/0059; A63B 69/0051; A63B 69/0057; A63B 21/4019; A63B 21/4021; A63B 21/4025; A63B 21/00189; A63B 2071/0625; A63B 2071/0633; A63B 2209/10; A63B 2209/14; A63B 2225/09

USPC ..... 473/450, 458, 464, 422, 59, 213, 212; D29/114, 113; 2/16, 160, 161.1–161.5, 2/168, 21

See application file for complete search history.

(56) References Cited

U.S. PATENT DOCUMENTS 3,062,546 A * 11/1962 Horton ..... A63D 5/00 473/61
3,497,218 A * 2/1970 Johnston ..... A63B 69/0002 473/458
3,880,426 A * 4/1975 Morse ..... A63D 5/00 473/61
3,888,482 A * 6/1975 Starrett ..... A63B 69/0002 473/458
4,689,828 A * 9/1987 Brewer ..... A41D 13/087 2/21

(Continued)

*Primary Examiner* — Mitra Aryanpour
(74) *Attorney, Agent, or Firm* — Dara L. Onofrio, Esq.; Onofrio Law

(57) ABSTRACT

A basketball shot training device comprising a wrist band 1; a finger piece 2 having two different size open ring holes 3, 4 for placement and securing on the user's index and middle fingers, a forked shaft portion 5 with a straight connection 6 to said open ring hole 3 for the index finger and a curved connection 7 to said open ring hole for the middle finger; and a straight shaft portion 8 connected at one end to said forked shaft portion and at the opposite end having an attachment means 9 to attach to said wrist band.

16 Claims, 3 Drawing Sheets

(56) References Cited

U.S. PATENT DOCUMENTS

| | | | | | |
|---|---|---|---|---|---|
| 4,881,275 | A | * | 11/1989 | Cazares | A63B 71/148 473/450 |
| 5,135,217 | A | * | 8/1992 | Swain | A63B 69/0071 473/450 |
| 5,466,215 | A | * | 11/1995 | Lair | A61F 5/0118 128/878 |
| 5,689,828 | A | * | 11/1997 | Mah | A63B 71/148 2/16 |
| D400,308 | S | * | 10/1998 | Paparella | D29/114 |
| 6,094,747 | A | * | 8/2000 | Malick | A41D 13/087 2/159 |
| D434,192 | S | * | 11/2000 | Warrior | D29/113 |

* cited by examiner

BASKETBALL SHOT TRAINING DEVICE TO IMPROVE JUMP SHOTS

This application claims the benefit of U.S. provisional application Ser. No. 62/405,821 filed Oct. 7, 2016 which is incorporated herein in its entirety by reference.

FIELD OF THE INVENTION

The present invention relates to a basketball shot training device to improve jump shots. In particular, the invention provides a shot training device that assists the ball player in performing a correct jump shot which enables the player to make consistent baskets.

BACKGROUND OF THE INVENTION

During basketball practice players are responsible for keeping count of how many shots are taken and at the end of the practice the player reports the number to the coach. Since the count is typically mental it is usually only an approximation.

In general shot counters are known in the prior art. For example, U.S. Pat. No. 6,945,882 to Strong discloses a portable timer/calculator for basketball players and can be used to count baskets made or missed. The device is a belt that is worn around a player's waist and they manually select the appropriate button during a specific period of time.

U.S. Pat. No. 6,418,179 to Shieh discloses a score counter for sensing the route of basket ball shots and includes a pair of photoelectric sensors installed at respective positions below an inner rim of a basket hoop to detect valid basketball shots. U.S. Pat. No. 6,389,368 to Hampton discloses a basketball score-keeping device for detecting shots attempted and made.

The present invention provides an advantage over these known devices by providing easier way to keep count of shots and also assists the player in performing a correct jump shot.

The invention helps basketball players keep count of how many shots are taken instead of mentally keeping track of the shots which can be erroneous.

For example, if a player takes two jump shots and one is made and the other is missed you are 1 for 2. With the invention device, if a player misses one shot and makes one shot, the two shots come up on the device but the player only has to count their missed shots.

The main purpose of the invention is to provide a shooting band device to help players maintain the perfect jump shot while also keeping count of the number of shot attempts made. The device includes two elastic rings which are attached to the index and middle finger of the players shooting hand. This allows the shooter to maintain the perfect jump shot when shooting the ball.

Another benefit of the invention is to assist the player in performing a correct jump shot. The invention device has a band that keeps count of how many shots a player takes, while the other piece snaps when a jump shot is performed correctly.

SUMMARY OF THE INVENTION

In the present invention, these purposes, as well as others which will be apparent, are achieved generally by providing a basketball shot training device comprising a wrist band and a finger piece having two open ring holes for placement and securing on the user's index and middle fingers attached to a single shaft preferably with a loop at the opposite end of the ring holes. In a preferred embodiment the wrist band is threaded through the loop to secure to the said finger piece.

The finger piece is preferably made of an elastic rubber material. The wrist band is made of a loop and hook material that is adjustable.

Other objects, features and advantages of the present invention will be apparent when the detailed description of the preferred embodiments of the invention are considered with reference to the drawings, which should be construed in an illustrative and not limiting sense.

DETAILED DESCRIPTION OF THE INVENTION

As used herein the specification and drawings the following is a list of components of the invention.

1—wrist band;
2—finger piece resistant bands;
3—open ring hole index finger;
4—open ring hole middle finger;
5—forked shaft portion;
6—straight connection to the opening hole index finger;
7—curved connection to the opening hole middle finger;
8—straight shaft portion;
9—attachment to the wrist band; and
10—shot counter.

Figure 1:
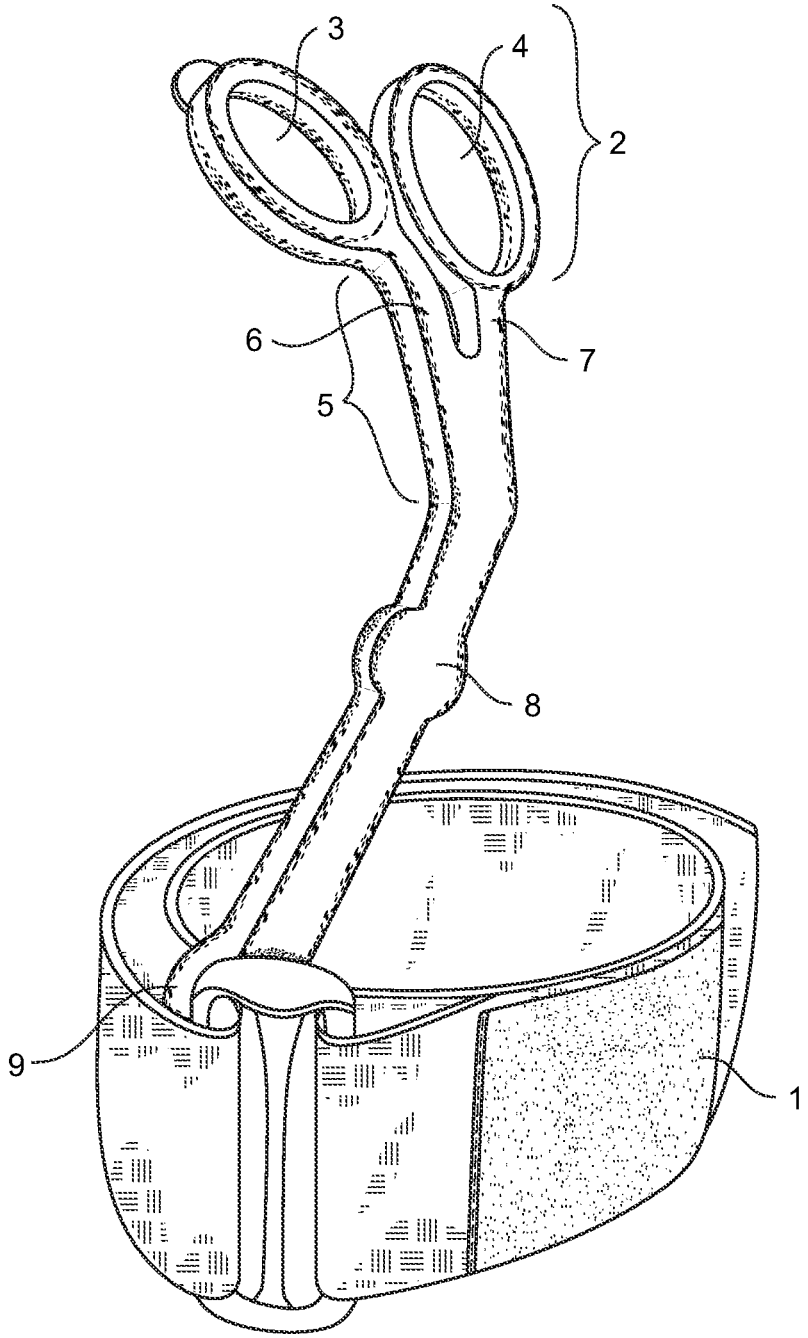
FIG. 1 illustrates the general components of the invention device.

In accordance with the present invention a basketball shot device is provided. The main components of the invention are illustrated in FIG. 1 and comprise essentially a finger piece 2 made of rubber resistance bands, preferably silicon rubber, with two holes for the proper finger placement attached to a wristlet 1 piece for securing around the user's wrist.

More particularly, the basketball shot training device comprises a wrist band 1 and a finger piece 2 having two different size open ring holes 3, 4 for placement and securing on the user's index and middle fingers. A forked shaft portion 5 with a straight connection 6 to the open ring hole 3 for the index finger and a curved connection 7 to the open ring hole for the middle finger; and a straight shaft portion 8 connected at one end to the forked shaft portion and at the opposite end having an attachment means 9 to attach to the wrist band.

The attachment means is preferably a loop wherein the wrist band is threaded through the loop to secure to the device.

In preferred embodiments the finger piece 2, the forked shaft portion 5 and the straight shaft portion are made of a flexible elastic rubber material.

In preferred embodiments the finger piece 2, the forked shaft portion 5 and the straight shaft portion are one continuous device.

In preferred embodiments the finger piece 2, the forked shaft portion 5 and the straight shaft portion are molded as one integral piece.

The wrist band is made of a loop and hook material that is adjustable to various sizes depending on the user's wrist size. The wrist band is preferably a loops and hook strap for easy attachment of the other components of the device. Preferably there is a loop at the bottom of the resistance band. The wristlet is looped through the hole and stretched while in use. This securely keeps the two pieces together, but they can easily be separated.

The wrist strap is a loop and hook material that is durable and can withstand the resistance of the finger bands constantly pulling on it. Other materials can be used in the invention to achieve this same result. The wrist band is adjustable to fit various wrist sizes.

The finger piece is essentially resistant bands for placing the user's fingers in the proper position for shooting a basketball and creating rotation which increases the user's chances of making a basket.

The resistance bands on the two fingers give the ball rotation. The resistance band material is flexible. The bands force the shooters fingers to go against the resistance bands, while the wrist strap goes around the wrist supporting the bands. The bands can be used by both left handed and right handed shooters.

Two plastic rings are located at the end of each of the elastic bands for securing on the users index and middle fingers. The rings can be in three sizes small, medium, and large to fit different size fingers. Alternatively, the rings can be elasticized to stretch to fit various sizes.

The finger resistance bands are adjustable. The user can place the bands on various positions on their index and middle fingers.

The purpose of the bands attached to the rings is to maintain the arch on the jump shot and the proper rotation as well. When the shot is in motion and the ball is released the rings will pull the string attached to the band creating a snap noise that lets the shooter know the perfect jump shot was made.

The invention device is expected to improve the player's jump shot dramatically by concentrating specifically on the form.

Figure 2:
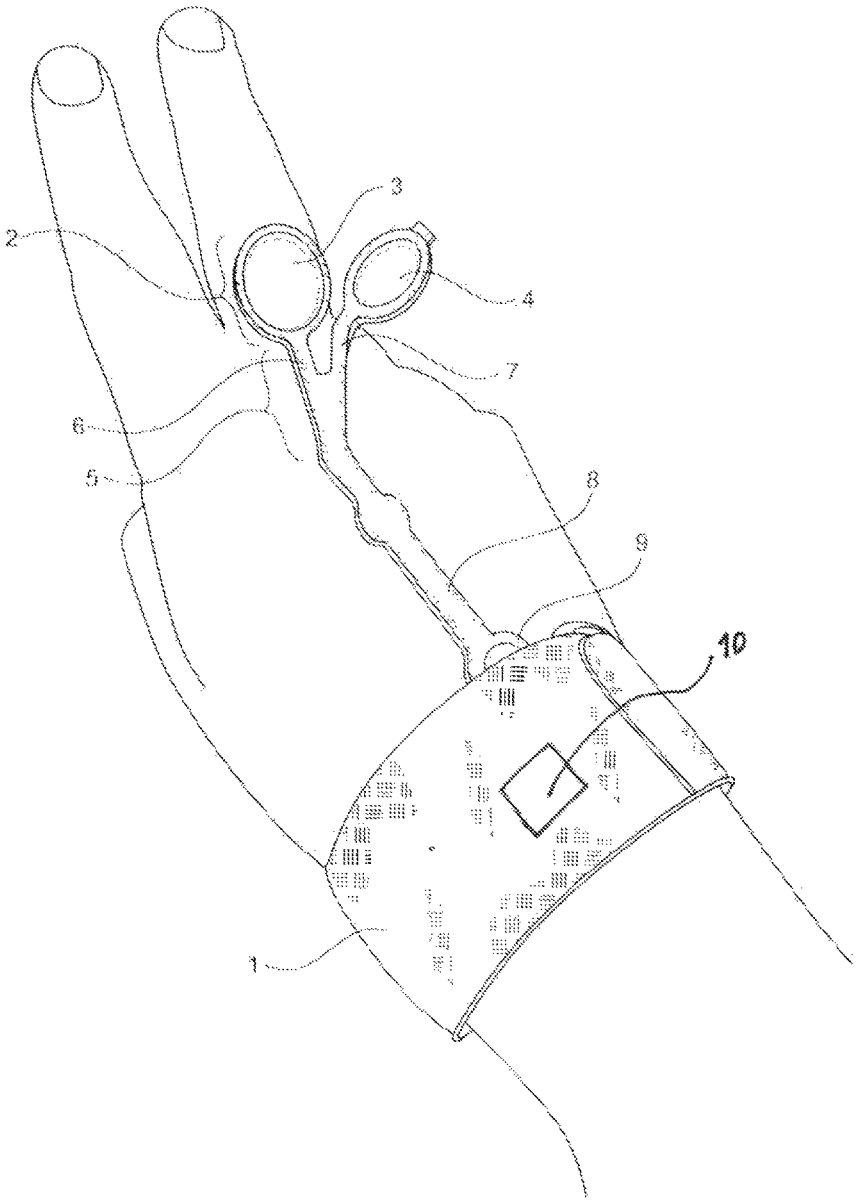
FIG. 2 illustrates the invention device on the user's wrist prior to securing on the user's fingers.
Figure 3:
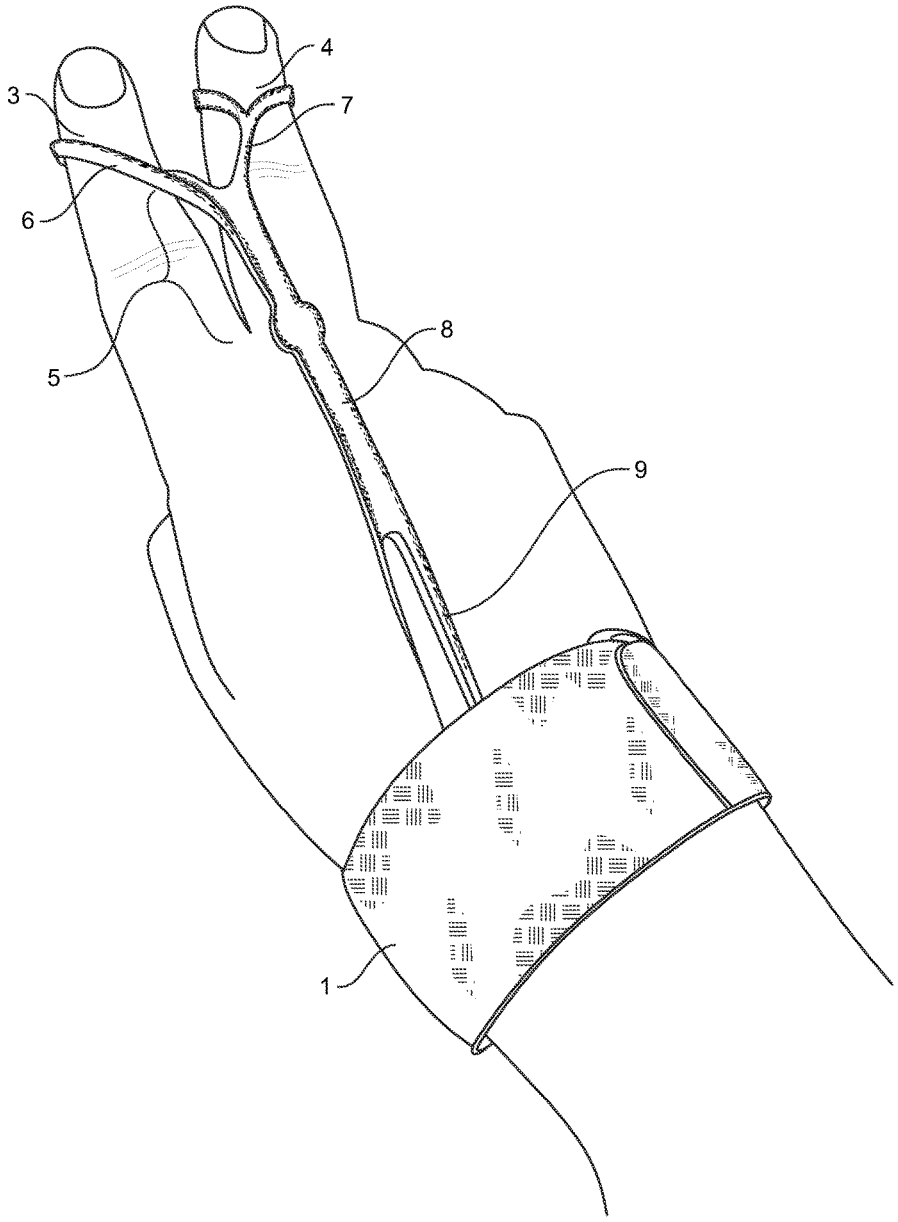
FIG. 3 illustrates the invention device on the user's wrist and secured on the user's fingers.

FIG. 2 illustrates the invention device on the user's wrist prior to securing on the user's fingers; and FIG. 3 illustrates the invention device on the user's wrist and secured on the user's fingers. Both these figures help to illustrate the invention training method for an improved basketball shot.

The method of the invention provides first providing a basketball shot training device comprising a wrist band 1; a finger piece 2 having two different size open ring holes 3, 4 for placement and securing on the user's index and middle fingers; a forked shaft portion 5 with a straight connection 6 to the open ring hole 3 for the index finger and a curved connection 7 to the open ring hole for the middle finger; and a straight shaft portion 8 connected at one end to the forked shaft portion and at the opposite end having an attachment means 9 to attach to the wrist band.

This device is attached to the user by wrapping the wrist band 1 to the user's wrist and stretching the device to attach the ring hole 3 to the users index finger and the ring hole 4 to the user's middle finger; wherein the stretching creates a resistance on the index and middle fingers.

A basketball is placed in the users hand with the device. When the user shoots the basketball with the device, it causes the users natural movement to go against the device such that when the ball is released ball rotation is created increasing the chances the ball will go in the basketball hoop.

The user can adjust the placement of the ring hole 3 and 4 on their fingers to change the shot rotation. The finger piece of the device is resistant bands.

The invention structure is important because the index finger and the middle fingers are the last two fingers to touch the basketball when shooting towards the basket. The wristlet is used to connect the finger bands because it secures the finger bands in place while shooting. The wristlet and resistance bands do not alter how a player catches the basketball but creates an effective workout by having the player keep their index and middle fingers in place for an improved jump shot.

One of the main components of shooting a basketball, if not the most important is rotation. Shooting a basketball with rotation increases your chances dramatically for the ball to go in the hoop. The finger resistance bands create a resistance on the index and middle causing the players natural movement to go against the bands to release the basketball. When the resistance bands are removed, the players index and middle fingers are both now pushing against the resistance that is no longer there causing the index and middle fingers to flick and propel the basketball harder causing a further range in shot. This will also allow the basketball to be shot off the fingers at a faster pace.

In a preferred embodiment the forked shaft portion 5 splits into a 20-degree V-shape at ⅚ of its length as measured from the wrist band. The straight shaft portion optionally has a 15-degree bend at ¾ of the length of this portion as measured from the wrist band. The open ring hole middle finger 4 is typically smaller than the open ring hole index finger 3. The curved connection 7 has an additional 15-degree bend in the direction to the right of the middle finger.

It is also within the invention scope to include a shot counter with the invention device.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A basketball shot training device comprising:

a wrist band (1);

a flexible finger piece (2) having two different size open ring holes (3), (4) for placement and securing on a user's index and middle fingers, respectively;

a V-shaped forked shaft portion (5); wherein said forked shaft portion (5) splits into a 20 degree V-shape at ⅚ of its length as measured from said wrist band;

a straight shaft portion (8) which is connected at one end to said forked shaft portion (5) and at the opposite end having an attachment (9) to attach to said wrist band; wherein said forked shaft portion (5) has a straight connection (6) to said ring hole (3) and a curved connection (7) to said ring hole (4); wherein said straight shaft portion (8) has a 15-degree bend at ¾ of the length of this portion as measured from said wrist band.

2. The basketball shot training device according to claim 1, wherein said attachment (9) forms an opening wherein said wrist band is threaded through said opening to secure to the device to the user's wrist.

3. The basketball shot training device according to claim 1, wherein said finger piece (2), said forked shaft portion (5) and said straight shaft portion (8) are made of a flexible elastic rubber material.

4. The basketball shot training device according to claim 1, wherein said finger piece (2), said forked shaft portion (5) and said straight shaft portion (8) are one continuous device.

5. The basketball shot training device according to claim 1, wherein said finger piece (2), said forked shaft portion 5 and said straight shaft portion (8) are molded as one integral piece.

6. The basketball shot training device according to claim 1, wherein said wrist band (1) is made of a loop and hook material that is adjustable.

7. The basketball shot training device according to claim 1, wherein said finger piece (2) are resistant bands.

8. A training method for an improved basketball shot comprising the steps of:

providing a basketball shot training device comprising: a wrist band (1);

a flexible finger piece (2) having two different size open ring holes (3), (4) for placement and securing on a user's index and middle fingers, respectively; a V-shaped forked shaft portion (5); wherein said forked shaft portion (5) splits into a 20 degree V-shape at ⅚ of its length as measured from said wrist band; a straight shaft portion (8) which is connected at one end to said forked shaft portion (5) and at the opposite end having an attachment (9) to attach to said wrist band; wherein said forked shaft portion (5) has a straight connection (6) to said ring hole (3) and a curved connection (7) to said ring hole (4); wherein said straight shaft portion (8) has a 15-degree bend at ¾ of the length of this portion as measured from said wrist band;

attaching said shot training device by wrapping said wrist band (1) to the user's wrist;

stretching said device to attach said ring hole (3) to the user's index finger and said ring hole (4) to the user's middle finger; wherein said stretching creates a resistance on the index and middle fingers;

placing a basketball in the user's hand with said device;

shooting the basketball with the device, causing the users natural movement to go against the device such that when the ball is released ball rotation is created increasing the chances the ball will go in the basketball hoop.

9. The method according to claim 8, wherein said ring hole (3) and (4) placement can be adjusted on the user's fingers.

10. The method according to claim 8, wherein said finger piece (2) are resistant bands.

11. The basketball shot training device according to claim 3, wherein said flexible elastic rubber material is silicon rubber.

12. The basketball shot training device according to claim 1, further comprising a shot counter (10).

13. The method according to claim 8, wherein said shot training device further comprises a shot counter (10) which counts the number of baskets made and completed.

14. The method according to claim 8, wherein said wristband is adjustable to be secured on the user's wrist.

15. The basketball shot training device according to claim 1, wherein said ring holes are small, medium or large to fit different size fingers.

16. The basketball shot training device according to claim 1, wherein said open ring hole (4) on the user's middle finger is smaller than the open ring hole (3) on the user's index finger.

* * * * *